US005640791A

United States Patent [19]

Fong

[11] Patent Number: 5,640,791

[45] Date of Patent: Jun. 24, 1997

[54] MUSICAL ORNAMENTAL CAROUSEL

[76] Inventor: Yi-Liang Fong, 4F, No. 16, Lane 56, Kang Ting Road, Taipei, Taiwan

[21] Appl. No.: 514,629

[22] Filed: Aug. 14, 1995

[51] Int. Cl.[6] ..... G09F 19/08

[52] U.S. Cl. ..... 40/414; 40/411; 472/29

[58] Field of Search ..... 40/411, 414; 446/359, 446/404, 484; 472/7, 29, 34, 39

[56] References Cited

U.S. PATENT DOCUMENTS

| | | | |
|---|---|---|---|
| 2,513,607 | 7/1950 | Webb | 472/29 |
| 3,191,930 | 6/1965 | Cottrell et al. | 472/6 |
| 4,753,436 | 6/1988 | Sinclair . | |
| 4,925,182 | 5/1990 | Hou | 472/6 |
| 5,078,386 | 1/1992 | Hou et al. | 472/7 |
| 5,203,743 | 4/1993 | Hou et al. | 472/7 |

*Primary Examiner*—Brian K. Green
*Attorney, Agent, or Firm*—Burns, Doane, Swecker & Mathis, LLP

[57] ABSTRACT

An improved musical ornamental carousel formed by assembly of various structural parts is disclosed and includes on the bottom thereof a base provided with a battery compartment, a hollow support post vertically located in the center of the base, a revolving disc rotatably supported on the upper part of the support post, a fixing disc located at the top of the hollow support post and spaced above the revolving disc. The carousel also includes a motor-driven musical box and a motor for driving the ornaments mounted on the fixing disc, a drive mechanism containing a plurality of differential gear sets disposed on the revolving disc and driven by the drive motor, several ornaments driven by the drive mechanism and capable of revolving around the central support post while simultaneously performing up-and-down movements by the action of the lift rod in cooperation with guiding posts provided on the revolving disc, and an umbrella-type canopy axially resiliently movably supported in the center on the upper part of the hollow support post by a slender shaft rod and a spring and covering over the revolving disc and the fixing disc. Conducting wires leading out from the battery compartment in the base are conductively connected via the hollow part of the hollow support post one by one in series to the drive motor and the musical box. Integrally formed with the revolving disc are positioning parts for allocating the drive mechanism and guiding posts for guiding the small figurines to perform up-and-down movements and structure of the guiding posts can thus be simplified to obtain the precise up-and-down movements.

5 Claims, 3 Drawing Sheets

MUSICAL ORNAMENTAL CAROUSEL

BACKGROUND OF THE INVENTION

1. Field of the Invention

The present invention relates to musical ornamental carousels and more particularly, to a miniature musical ornamental carousel which upon being actuated is capable of emitting pleasant musical sounds from an internally concealed musical box while at the same time permitting several ornamental articles like wooden horses to rotate around a central support post performing up-and-down movements to the music and having a dynamic ornamental effect.

2. Prior Art

Until now, there are many kinds of articles that can be used as desk top movable decoration articles or Christmas decoration articles, to cite a few examples these articles include a lantern adorned with a revolving circle of paper horses and with light and music, a small decoration article swingable in a swing, a small drum beating and wind instrument playing doll. These known movable decoration articles perform only a simple return action or rotating movement. Because in these movable decoration articles the action is different and also the design is different, their constructions therefore vary from each other.

In U.S. Pat. No. 5,078,386 to Hou et al., there is disclosed a Christmas musical decoration article of a small merry-go-round apparatus having a base stand with a concealed miniature spring-tensioned musical box, a hollow central support mounted vertically on the base stand, a drive shaft located inside the central support and driven directly by the musical box mechanism, a fixed shaft fitted on the outer circumstance of the drive shaft for supporting the bearing, a ceiling plate rotatably supported on the bearing, a canopy mounted to the upper end of the drive shaft and covering the upper portion of the ceiling plate, and a plurality of ornaments of small wooden horses suspending from the lower side of the ceiling plate and driven into action by the drive shaft via the gear driven mechanism. In this apparatus because the driving force that enables several ornaments to produce up-and-down rotating movements is achieved by the energy that has been accumulated by the tensioned spring originally designed to drive of the musical box, it is necessary that the transmission path passes from the lower gear, through the vertical drive shaft, the upper gear set, and the ceiling plate to the ornaments. The path is long and the friction loss in between is also large. Consequently, the musical box mechanism is always unable to withstand the frictional load, which frequently leads to a slowdown in the speed of the music and the ornaments and the inability even to continue action within a very short period, but is frequently in need of repeated tensioning of the spring. This repeated tensioning is rather troublesome unless overcome by use of a larger music box with sufficient spring energy. Besides, in this type of construction a coaxial shaft tube and a main drive shaft must be mounted in the hollow support. Additionally, on the upper ends of the shaft tube and the support, mounting of ball bearings and related structural parts are required. Because of these and also of the ceiling plate which requires provision thereon of many pairs of vertical parallel guide rails to lead the ornaments to perform up-and-down undulating movement via a follower plate, it has thus resulted in the number structural parts becoming numerous, an increase in weight, trouble in operation of the assembly and an increase in cost, which have all been problems with the musical decoration of U.S. Pat. No. 5,078,386.

U.S. Pat. No. 4,753,436 to Sinclair discloses a motor-driven musical carousel structure, the drive mechanism of which, however, comprises a friction wheel located at the lower part of the lower disc, a plurality of accurate track elements and the wheels that can traverse the said track elements, and a plurality of rubber tires disposed beneath the canopy and capable of sliding on the lower disc. Such an apparatus can use a power supply to provide motor current and perform long hours of operation and it is not necessary to always tighten up the spring as in the aforesaid patent. However, the structure of several wheels and the track, the fitting and assembly also bring in a few complications and problems, and the exposure to outside of the lower drive mechanism is also a cause for concern regarding aesthetics.

SUMMARY OF THE INVENTION

Accordingly, an object of the present invention is to provide an improved musical ornamental carousel, the miniature ornaments of which are able to perform up-and-down undulating movements following the musical sounds while the entire structure of which is simple with a reduced number of structural parts, which are easy to assemble and the cost of production being comparatively low.

A further object of the present invention is to provide an improved musical ornamental carousel, a central support post of which does not have a coaxial shaft tube and a main drive shaft.

Another object of the present invention is to provide an improved musical ornamental carousel directly driving the gear drive mechanism by a motor to obtain long hours of operation and actual up-and-down undulating movements by the small ornaments.

A further object of the present invention is to provide an improved musical ornamental carousel permitting the guiding structure, which enables the small ornaments to perform up-and-down undulating movements, to have reduced assembling parts through simplification.

In accordance with one embodiment of the present invention, the aforesaid and other objects are achieved by providing a musical ornamental carousel formed by assembly of various structural parts, having on the bottom thereof a base provided with a battery compartment, a hollow support post vertically located in the center of the base, a revolving disc rotatably supported on the upper part of the hollow support post, a fixing disc located at the top of the hollow support post and opposed spacedly to the revolving disc, a miniature motor-driven musical box and a miniature motor for driving the ornaments mounted on the fixing disc, a drive mechanism containing a plurality of differential gear sets disposed on the revolving disc and driven by the aforesaid drive motor, several ornaments driven by the drive mechanism and capable of revolving around the central support post while simultaneously performing up-and-down undulatory movements by the action of the lift rod in cooperation with guiding posts provided on the revolving disc, and an umbrella-type canopy being axially resiliently movably supported in the center on the upper part of the hollow support-post by a slender shaft rod and a spring and covering over the revolving disc and the fixing disc.

In the musical ornamental carousel of the present invention, the conducting wires leading out from the battery compartment in the base are conductively connected via the hollow part of the hollow support post one by one in series to the drive motor and the musical box and, if necessary, can be further joined to a series of decoration lamps disposed on the fixing disc or on the inside of the canopy so as to add a light emitting effect besides those effects of music and action.

Integrally formed with the revolving disc are a positioning part for allocating the drive mechanism and guiding posts for guiding the small figurines to perform up-and-down movements and structure of the leading portion can thus be simplified to obtain the precise up-and-down movements.

BRIEF DESCRIPTION OF THE DRAWINGS

The foregoing and the other objects, features and advantages of the invention will be apparent from the following description of a preferred embodiment of the invention, taken in conjunction with the accompanying drawings wherein.

DETAILED DESCRIPTION OF THE PREFERRED EMBODIMENTS

Figure 1:
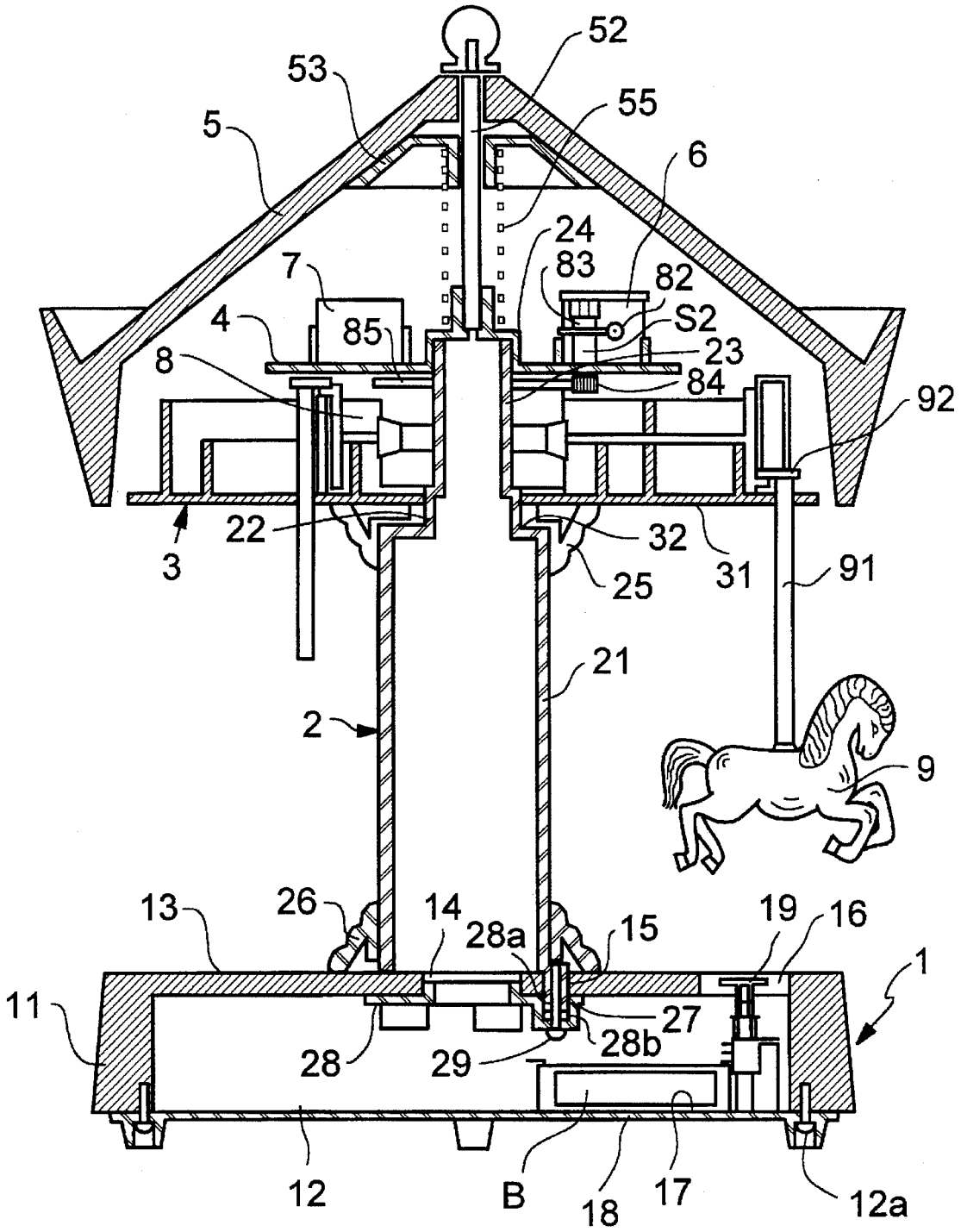
FIG. 1 is a longitudinal sectional view of a musical ornamental carousel of the present invention.
Figure 2:
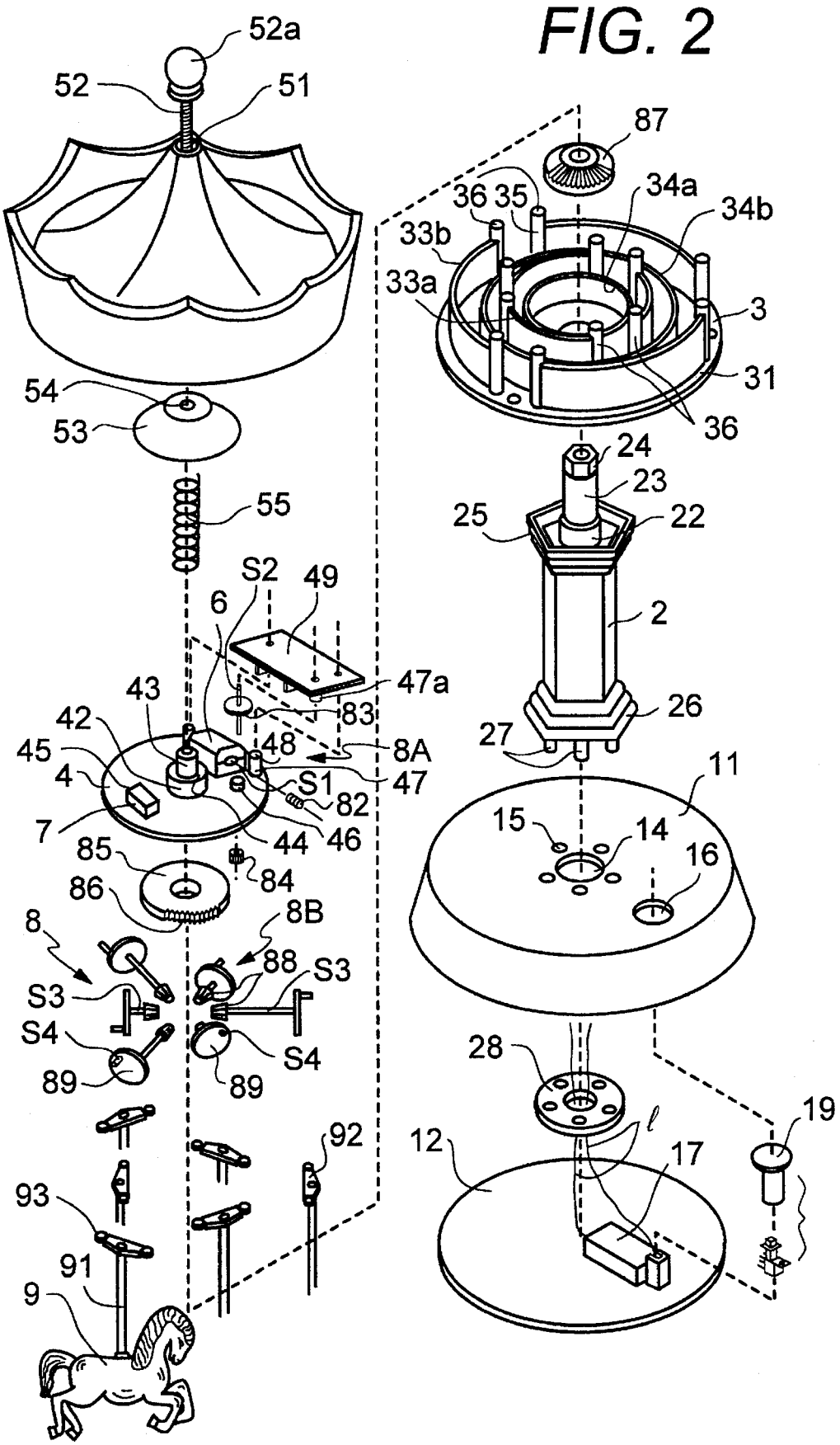
FIG. 2 is an exploded perspective view of the musical ornamental carousel of the present invention.

Referring now to FIGS. 1 and 2, a preferred embodiment of the musical ornamental carousel of the present invention shall be described as follows.

A musical ornamental carousel 10 according to the preferred embodiment of the present invention comprises a hollow base 1, a hollow support post 2 vertically mounted in the center of the upper surface of the base 1 and extending upwardly, a revolving disc 3 being rotatably supported on the upper part of the hollow support post 2, a fixing disc 4 disposed on the apex of the hollow support post and opposed spacedly to the revolving disc 3, an umbrella-type canopy 5 supported on the top of the central projecting post of the fixing disc 4 by a shaft rod 51 covering over both the revolving and fixing discs, a miniature drive motor 6 and a musical box 7 located on the fixing disc, a gear drive mechanism 8 mutually drivably disposed on the revolving disc 3, and a plurality of ornaments 9, for example, toy horses, suspending from below the revolving disc 3 and capable of being driven to perform up-and-down undulating movements.

The base 1 comprises a cap-like base body 11 and a base plate 12 separably joined with the base body 11 to form a single body by known retaining means 12*a*, for example, screws or snap fixing. The upper surface 13 of the base body 11 is provided in the center with a central hole 14, in the periphery of the central hole 14 are several post positioning holes 15 and in addition, on the upper surface near the outer edge there is a switch hole 16. Next, a downwardly opening battery compartment 17 is integrally formed on the inner surface of the base plate 12. On the opening of this battery compartment 17 is provided an openable lid 18 and at one end of the battery compartment 17 is a press-button switch 19, the press button of which being slightly exposed to the outside of the switch hole 16. In order to take advantage for mass production at an inexpensive price, it is preferable that the base 1 be made by injection molding of a synthetic resin (plastic) material. In the present embodiment, the base 1 is formed in a circular shape, however, it may also be formed in a square with the corner portions thereof forming an arc shape, triangular, elliptical, polygonal or any other suitable shape.

The hollow support post 2 is formed in a large diameter cylindrical body 21 having on the upper end at the center thereof a section of upwardly extending small diameter portion. The small diameter portion including, in order, in a larger-diameter cylindrical journal 22 acting both as a revolving disc engaging portion and a bearing portion, a longer smaller-diameter cylindrical shaft tube portion 23 and a polygonal barrel portion 24 of a polygonal shape in section on the uppermost end.

In order that this support post 2 is more stable and esthetic in construction, there are formed respectively on the upper and lower ends a crown portion 25 and/or a base portion 26. The crown portion 25 and the base portion 26 are preferably integrally formed with the support post 2 whereas on the inner side of the base portion 26 there is formed surrounding the cylindrical body 21 a plurality of downwardly extending positioning pins 27 corresponding to the positioning holes 15 in the base 1 and adapted to be inserted in the positioning holes 15. The hollow support post 2 is fixed in the center on the upper surface of the base 1 by inserting those positioning pins 27 in the corresponding positioning holes 15 and again by retaining means, fixing plate 28 and screws 29. This fixing plate 28 is pressed closely against the inner side of the base body 11 by the central protruding portion 28*a* being engaged from below in the central hole 14 of the base body 11 and by the lower ends of the aforesaid positioning pins 27 being received in the cavity 28*b* and next fixed with screws 29. The support post 2 is preferably formed by molding of synthetic resin and its cylindrical body portion 21 is, in the present embodiment, formed of a hexagonal shape in section. However, it is not limited to this shape and it is equally possible that sections, such as, of a circular, square or polygonal, pentagonal or octagonal shape, or any other suitable arbitrary shape are adopted. Again, the crown portion 25 and/or the base portion 26 of the support post may also be formed as individual articles and be join with the cylindrical body 21 as a single body by appropriate connecting means. If it is intended that the structure of the support post 2 be simplified, the crown portion 25 and the base portion 26 may also be omitted. Furthermore, if the fixing plate 28 for insertion therein of the positioning pins 27 has only holes in place of the abovesaid cavity, a simple ring-shaped circular plate will do.

The revolving disc 3 is a structural part formed of synthetic resin, comprising a disc body 31, a hub 32 located on the lower center of the disc body 31 downwardly projecting to be rotatably fitted over the journal (bearing) 22 of the support post 2 and having the end settled on the 25 shoulder 21*a* of the cylindrical body 21. The revolving disc 3 also includes several curved blades 33*a*, 33*b* mounted along inner and outer circular tracks on the upper side of the disc body 31, an inner support ring 34*a* formed on the upper surface of the disc body 31 and located between the hub 32*a* and the inner curved blades 33*b* for supporting a portion of the gear mechanism. An outer support ring 34*b* formed on the upper surface of the disc body 31 and located between the inner and outer curved blades 33*a* and 33*b* for supporting the other portion of the gear mechanism. Several pairs of guiding posts 36 are respectively formed on the same upper surface and located between the inner and outer curved blades 33*a* and 33*a* and 33*b* and 33*b* and having the section opposed to the guide channel 35 to be of a C-shape. Several lifting arm insertion holes 37 are provided on the disc body 31 in the middle of each pair of guiding posts 36. Opposing directly to the inner and outer support rings 34*a*, 34*b* and the inner curved blades 33*b* on the central position between each of the corresponding paired guiding posts 36 is formed a cavity 38 for engagement of a gear shaft to be described hereinbelow and also acting as its bearing. Since, member of each part in the revolving disc 3 of the above construction are integrally formed, any assembly procedure can thus be omitted, especially in the assembly and fixing of guide rails 65 and bearings 30 disclosed in U.S. Pat. No. 5,078,386.

The fixing disc 4 is a circular plate made by forming of a synthetic resin, in the center of which there includes a lid 42 protruding upwardly and having the inner circumference formed with a polygonal hole 41 corresponding to the polygonal cylindrical portion 24 of the support post 2 and a small-bore female threaded cylindrical part 43 projecting upwardly from the upper center of the lid 42. The lid 42 is provided on the upper surface with a conducting wire lead hole 44. On the upper surface of the fixing disc 4 are formed a musical box fixing part 45, a motor fixing part 46, a bearing part 47 and a supplementary plate fixing part 48. The fixing disc 4 is engaged by the polygonal hole 41 to the polygonal cylindrical portion 24 and with the revolving disc 3 spaced-apart and in parallel is fixed to the upper end of the support post 2, the supplementary plate 49 being fixed to the upper surface of the fixing part 48 and having a bearing 47*a* corresponding to the bearing part 47. Also, preferably the fixing disc 4 extends outwardly to cover over the upper side of the guiding posts 36.

The canopy 5 is formed of a synthetic resin and includes on the upper end a crown or umbrella-shaped body having a pass hole 51. This canopy 5 is positioned in place by threading a shaft rod 52 into the threaded cylindrical part 43 of the fixing disc 4 after it is inserted from above. The threaded end of the shaft rod 52 has on the upper end a head portion 52*a*. The threaded end of the shaft rod 52 is passed through the pass hole 51 and the central hole 54 of the inverted dish-shaped spring bearing seat 53 located on the upper inner surface of the canopy 5 and cooperating with said inner surface, and maintains in the normal position as shown in the drawing by the upwardly and downwardly pushing force of a compression spring 55 fitted on the outer circumference of the shaft rod 52 and having two ends respectively pressing against the spring bearing seat 53 and the lid 42. However, when it is under an axially downwardly directed external force which is greater than the spring 55, the canopy 5 can make a limited movement downwardly along the shaft rod 52. Again, when a dish-shaped spring bearing seat 55 is used it can increase the contact area with the canopy 5 and maintain a more stable condition.

The miniature motor 6 and the known motor-driven type musical box 7 are fixed respectively in the fixing parts 45 and 46 on the fixing disc 4, the current source of which from the battery B accommodated in the battery compartment 17 is supplied by a lead which is led out after passing through the hollow support post 2 via the switch 19 and connected in series to the motor 6 and the musical box 7. Therefore when the switch 19 is pressed on, the motor 6 rotates and simultaneously the musical box emits a pleasant musical tune. It will also do if for a change this musical box 7 is mounted inside the base 1 and not on the fixing disc 4.

Figure 3:
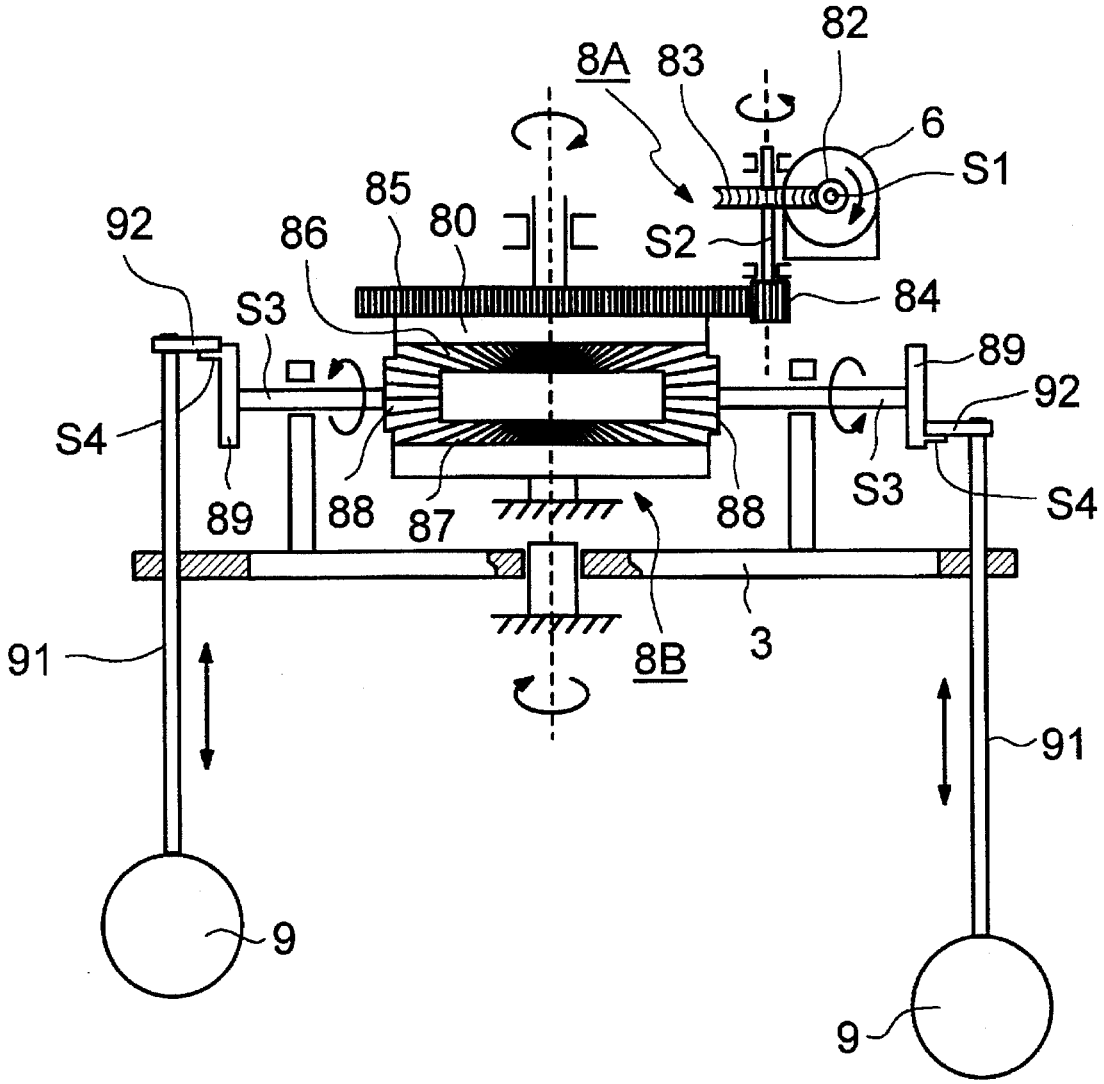
FIG. 3 is a schematic view of the drive route of the musical ornamental carousel of the present invention.

The gear drive mechanism 8 includes a reduction drive set 8A disposed on the fixing disc 4 and driven by the motor 6 and a differential gear set 8B disposed on the revolving disc 3. In the former as shown in FIGS. 1 and 3, this comprises a worm 82 fixedly mounted on the output shaft S1 of the motor 6, a worm gear 83 supported between the bearing part 47 of the fixing disc 4 and the bearing part 47*a* of the supplementary plate 49 by a shaft 52, and a pinion 84 fixed to the lower end of the shaft 2 passing through the lower surface of the fixing disc 4. The latter, on the other hand, comprises a drive composite gear 80 rotatably fitted on the shaft tube portion 23 and having a spur gear 85 engageable with the pinion 84 and a bevel gear 86 located in the lower part of the spur gear 85 and with which it is integrally formed, a fixed bevel gear 87 fixed to the lower part of the shaft tube portion 23 and opposed to and having the same number of teeth as the bevel gear 86, several bevel pinions 88 arranged spaced-apart radially and each of which being engaged to an upper bevel gear 86 and a lower bevel gear 87, and several eccentric wheels 89 located on one end of the shaft 3 of each of the bevel pinions 88 and having eccentric shafts 4 outwardly protruding. The two bevel gears 86, 87 and several bevel pinions 88 constitute suitably the differential gear mechanism. In the present embodiment, as the assembly is designed so that on the two inner and outer concentric circular tracks, each three ornaments 9 on the inner and outer sides are made to perform revolving undulatory movements around the support post 2, therefore in conformance with the two circular tracks bevel pinions 88 having shafts 3 of two different lengths are used. It is obvious however that if the same circular track is used for movement, then the length of the shaft 3 may be used of the same length.

The ornaments 9 include a lift rod 91 having the upper end extending vertically upwardly and a guide plate 92 fixed to the upper end of the lift rod 91 and constituting a T shape with the said lift rod. The guide plate 92 is formed on the two ends with rounded end portions 93 adapted to be slidably engaged in the guide channel 35 of the guiding posts 36. It is also possible that this rounded end portion 93 can be replaced with a spherical shape (not shown). The ornaments 9 in the present embodiment are represented by horse figurines, which are suspended on the lower side of the revolving disc 3 after passing through the pass hole 37 of the revolving disc 3 from below by the lift rod 91 permitting the rounded end portions 93 on the two ends of the guide plates 92 to be engaged in the guide channel 35 and allowing the lower surface thereof to be engaged on the eccentric shaft S4 of the corresponding eccentric wheel 89.

Based on the above description, the operation of the musical ornamental carousel mechanism will now be described hereinbelow.

First, when the switch 19 is pressed down the circuit is on and the musical box 7 starts to emit musical tunes. At the same time the motor 6 also starts to operate and, as shown in FIG. 3, the output torque force is transmitted to the reduction drive set 8A via, the output shaft S1 and again transmitted to the differential gear set 8A thereby permitting the revolving disc 3 to rotate around the support post 2. The ornaments 9 following the revolving disc 3 begins to rotate. While rotating on one hand, the ornaments 9 also are lead on the other hand by the guide posts 36 to perform the up-and-down movements. More particularly, after the motor 6 has run, the worm 82 starts to drive the worm gear 83 and the coaxial pinion 84 to decelerate rotations. Subsequently, the pinion 84 drives the gear wheel 85 and the integrally formed bevel gears 86 as well into rotation. Owing to this differential relation, several bevel pinions 88 that engage between the two bevel gears 86, 87 are driven by the upper bevel gear 86 into rotation on one hand, while on the other hand, following the lower bevel gear 87 to perform revolution in the similar direction of the bevel gear 86. The revolving disc 3 is thus moved to rotate by the shaft 3 of each gear 88 via supporting rings 34*a*, 34*b* and the cavity 38 of the curved blade 33*b* and following this, the ornaments that are suspended on this revolving disc 3 also rotate around the support post 2. Concurrently, as the eccentric wheel 89 rotates together with the gear 88, and following the eccentric wheel 89 its eccentric shaft 8 also rotates and drives the guide plate 92 to perform up-and-down reciprocating motion along the guiding channels 35 of the guide posts 36. The ornaments 9 as a result rotate on one hand and perform the up-and-down undulating movements on the other hand.

Also, if a series of decoration lamps are fixed to the canopy 5 or the fixing disc 4 and are connected by conducting wire (not shown), light will be emitted from the lamps during the same time as the action of the ornaments.

It is apparent from the above description that the structure according to the present invention is simple, both assembly and disassembly are easy, the cost is low and the mechanism operates precisely.

Although the invention has been described in detail with reference to its presently preferred embodiment, it will be understood by one of ordinary skill in the art that various modifications can be made without departing from the spirit and scope of the invention. Accordingly, it is not intended that the invention be limited, except as by the appended claims.

I claim:

1. A musical ornamental carousel of a type wherein after a current source has been supplied a musical box emits a musical tune while several ornaments rotate around a central support post and perform up-and-down motion, comprising:

(a) a base provided in an interior with a battery compartment and a press-button switch;

(b) a hollow support post vertically mounted on an upper center of the base;

(c) a revolving disc rotatably supported on an upper end portion of the hollow support post and having on an upper central part thereof formed with a drive mechanism placement positioning portion and several lift rod guide post portions disposed equally spaced along a circumference of the revolving disc;

(d) a fixing disc fixed to the upper end portion of the hollow support post and being spaced-apart from the revolving disc;

(e) an umbrella-shaped canopy being removably sustained on an upper part of a central protruding post of the fixing disc by a shaft rod and spring for covering the revolving disc and fixing the disc under the umbrella-shaped canopy;

(f) a miniature drive motor and musical box disposed on the fixing disc;

(g) a set of gear drive mechanisms couplingly arranged on the revolving disc and capable of being driven by the miniature drive motor, and being mutually driven while capable of moving the revolving disc into rotation; and (h) several ornaments suspended on a lower part of the revolving disc by a plurality of lift rods and capable of following the revolving disc to rotate and perform up-and-down undulating movements by the set of gear drive mechanisms via a guide post portion of the lift rods.

2. The musical ornamental carousel of claim 1, wherein said revolving disc includes a circular disc body having a center provided with a downwardly protruding hub portion, supporting rings formed on an upper inner circumference of the circular disc body for supporting the set of gear drive mechanisms, several curved blades formed on an upper surface of the circular disc body and located in at least one of a plurality of circular tracks on an outer side of the supporting rings, the lift rod guide post portions formed between each of two curved adjacent blades and having a pair of parallel and vertically arranged guide channels, and several lift rod inserting holes located in a center of each guide post portion and passing through said circular disc body.

3. The musical ornamental carousel of claim 1, wherein said gear drive mechanism comprises a motor-driven reduction gear set disposed on the fixing disc and a differential gear set disposed on the revolving disc, said reduction gear set including a worm directly connected to an output shaft of the motor, a worm gear driven by said worm and pinions fixed to one end of a shaft of said worm gear, said differential gear set including a spur gear rotatably mounted on the hollow support post and being in engagement with and driving said pinions, a rotatable bevel gear being concentric and integrally formed on lower part of said spur gear, a fixed bevel gear fixed to the hollow support post and spaced apart from and opposed to said rotatable bevel gear and having a same number of teeth, several bevel pinions equally spaced and radially arranged in between said two bevel gears and simultaneously engaged with said two gears to perform differential motion, and a same number of eccentric gears disposed on one end of a shaft of each bevel pinions and having outwardly protruding eccentric shafts.

4. The musical ornamental carousel of claim 2, wherein said lift rod guide portions comprise two opposed guide posts having C-shaped guide channels, an upper end opening of said guide channels being covered over by a part of the fixing disc.

5. The musical ornamental carousel of claim 2, wherein said gear drive mechanism comprises a motor-driven reduction gear set disposed on the fixing disc and a differential gear set disposed on the revolving disc, said reduction gear set including a worm directly connected to an output shaft of the motor, a worm gear driven by said worm and pinions fixed to one end of a shaft of said worm gear, said differential gear set including a spur gear rotatably mounted on the hollow support post and being in engagement with and driving said pinions, a rotatable bevel gear being concentric and integrally formed on a lower part of said spur gear, a fixed bevel gear fixed to the hollow support post and spaced apart from and opposed to said rotatable bevel gear and having a same number of teeth, several bevel pinions equally spaced and radially arranged in between said two bevel gears and simultaneously engaged with said two gears to perform differential motion, and a same number of eccentric gears disposed on one end of a shaft of each bevel pinions and having outwardly protruding eccentric shafts.

* * * * *